US012752332B2

(12) United States Patent
Sieber et al.

(10) Patent No.: US 12,752,332 B2
(45) Date of Patent: Oct. 6, 2026

(54) METHOD AND FORMING DEVICE FOR PRODUCING RING-SHAPED FORMED PARTS

(71) Applicant: Hatebur Umformmaschinen AG, Reinach (CH)

(72) Inventors: Carsten Sieber, Basel (CH); Olivier Ritter, Village-Neuf (FR)

(73) Assignee: Hatebur Umformmaschinen AG, Reinach (CH)

( * ) Notice: Subject to any disclaimer, the term of this patent is extended or adjusted under 35 U.S.C. 154(b) by 0 days.

(21) Appl. No.: 18/874,350

(22) PCT Filed: Jun. 8, 2023

(86) PCT No.: PCT/CH2023/050021
§ 371 (c)(1),
(2) Date: Dec. 12, 2024

(87) PCT Pub. No.: WO2023/240371
PCT Pub. Date: Dec. 21, 2023

(65) Prior Publication Data

US 2025/0375810 A1 Dec. 11, 2025

(30) Foreign Application Priority Data

Jun. 13, 2022 (CH) ..... 714/2022

(51) Int. Cl.
*B21D 53/10* (2006.01)

(52) U.S. Cl.
CPC ..... *B21D 53/10* (2013.01)

(58) Field of Classification Search
CPC ..... B21D 53/10; B21K 1/04; B21K 1/761; B21K 21/08; B21K 21/02; B21K 21/06;
(Continued)

(56) References Cited

U.S. PATENT DOCUMENTS 1,387,638 A * 8/1921 Bingham ..... F16C 19/364
29/898.066
3,968,674 A 7/1976 Ishida
(Continued)

FOREIGN PATENT DOCUMENTS

CN 104959510 A * 10/2015 ..... B21J 13/02
CN 105057556 A * 11/2015
(Continued)

OTHER PUBLICATIONS

English translation of JP-59197335-A (Year: 1984).*
(Continued)

*Primary Examiner* — Jun S Yoo
(74) *Attorney, Agent, or Firm* — The Webb Law Firm

(57) ABSTRACT

A method for producing an inner and an outer ring-shaped formed part from a blank includes the step of cup extrusion of the blank to form a cup having a drawn-out cup base and an adjoining stepless cup wall and the step of forming the cup wall in such a way that the formed cup wall includes an inner ring-shaped section and an adjoining outer ring-shaped section which is partly offset in an axial direction. The method further includes the step of separating the outer ring-shaped section from the inner ring-shaped section and separating the inner ring-shaped section from the drawn-out cup base, the detached outer ring-shaped section constituting the outer ring-shaped formed part and the detached inner ring-shaped section constituting the inner ring-shaped formed part.

5 Claims, 4 Drawing Sheets

(58) Field of Classification Search
CPC ... F16C 33/64; F16C 33/58; B21J 5/06; B21J 5/12
See application file for complete search history.

(56) References Cited

U.S. PATENT DOCUMENTS

| | | | |
|---|---|---|---|
| 4,590,780 | A | 5/1986 | Bachmann |
| 6,065,322 | A | 5/2000 | Tabata et al. |
| 10,670,133 | B2 | 6/2020 | Guhe |
| 10,828,686 | B2 | 11/2020 | Ochiai |
| 2018/0297108 | A1 | 10/2018 | Matt et al. |

FOREIGN PATENT DOCUMENTS

| | | | | | |
|---|---|---|---|---|---|
| CN | 105057556 | B | | 3/2017 | |
| DE | 102013112123 | B4 | | 9/2019 | |
| EP | 3450046 | A1 | | 3/2019 | |
| EP | 3106244 | B1 | | 10/2019 | |
| EP | 3362204 | B1 | | 11/2019 | |
| JP | 59197335 | A | * | 11/1984 | |
| JP | 2004141964 | A | | 5/2004 | |
| JP | 2005288505 | A | * | 10/2005 | ..... F16C 33/64 |
| JP | 2008302403 | A | | 12/2008 | |
| JP | 2009279627 | A | | 12/2009 | |
| JP | 201125312 | A | | 2/2011 | |
| JP | 2013240819 | A | | 12/2013 | |
| KR | 1020170072395 | A | | 6/2017 | |
| WO | WO-2016098886 | A1 | * | 6/2016 | ..... F16C 33/64 |
| WO | 2017072173 | A1 | | 5/2017 | |
| WO | 2020254011 | A1 | | 12/2020 | |
| WO | 2021156791 | A1 | | 8/2021 | |
| WO | 2022009903 | | | 1/2022 | |
| WO | 2022009903 | A1 | | 1/2022 | |

OTHER PUBLICATIONS

English translation of CN-104959510-A (Year: 2015).*
English translation of CN-105057556-A (Year: 2015).*
English translation of JP-2005288505-A (Year: 2005).*
English translation of WO-2016098886-A1 (Year: 2016).*

* cited by examiner

METHOD AND FORMING DEVICE FOR PRODUCING RING-SHAPED FORMED PARTS

CROSS-REFERENCE TO RELATED APPLICATIONS

This application is the United States national phase of International Patent Application No. PCT/CH2023/050021 filed Jun. 8, 2023, and claims priority to Swiss Patent Application No. CH000714/2022 filed Jun. 13, 2022, the disclosures of which are hereby incorporated by reference in their entireties.

BACKGROUND

Field of the Invention

The present invention relates to a method and a device for producing an inner and an outer ring-shaped formed part from a blank.

Description of Related Art

In the production of rolling bearing rings, typically first of all a pair of rings is produced in a forming device, one of which rings constitutes the inner ring and the other of which constitutes the outer ring of a rolling bearing. In known methods for the production of the said rings, first of all a shaped blank is produced from a blank by cup extrusion, the shaped blank having an inner and an outer ring-shaped section and a cup base or slug. Those ring-shaped sections are then separated from one another and from the cup base and processed further by means of further working steps, such as rolling and expansion, to form the inner ring and the outer ring of the rolling bearing, as described, for example, in EP 3 362 204 B1.

U.S. Pat. No. 6,065,322 A discloses a method in which the shaped blank having the two ring-shaped sections and the cup base or slug is produced from the blank in one forming step by means of cup extrusion. In this forming method a stepped forming punch presses against the blank arranged in a forming die, with the result that the two ring-shaped sections and the cup base are shaped from the blank in one forming step—that is to say in only one forming station using only one die and without the forming station or the die being modified.

In order to be able to separate the two ring-shaped sections from one another and to allow further processing to form the rolling bearing rings, the ring-shaped sections are typically arranged in such a way that they do not overlap in a radial direction and are offset in an axial direction. This requires a stepped profile of the forming die and a corresponding stepped profile of the forming punch of the forming station.

A problem in this regard is that the stepped profile of the forming punch and of the forming die restricts the flow of the material of the blank during the cup extrusion. The material cannot be displaced unhinderedly by the forming punch, and the cup base of the formed part therefore cannot be drawn out as thinly as desired. Since the cup base, or slug, is removed in a subsequent working step and discarded as waste material, this results in an unnecessarily large amount of waste material which should be reduced as much as possible.

CN 105057556 B discloses a method in which a cylindrical blank is first of all pre-shaped by cup extrusion into a cup having a cup base and an adjoining stepless cup wall. In a next step, the cup wall and the cup base are then further formed into a shaped blank having an inner and an outer ring-shaped section and a residual base portion in the centre of the inner ring-shaped section. As in the case of the method known from U.S. Pat. No. 6,065,322 A, this is effected by means of a stepped forming punch and a stepped forming die with the known problem that the flow of the material is restricted during the forming and the material cannot be displaced unhinderedly by the forming punch and therefore the residual base portion cannot be drawn out as thinly as desired. In addition, after the pre-shaping both the pre-shaped cup wall and the pre-shaped cup base need to be subjected to further forming.

SUMMARY

Against that background, the problem underlying the invention is to provide a method and a forming device which make it possible to draw out the cup base of the shaped blank more thinly than in the known methods using the known forming devices and thus to minimise the amount of waste material.

That problem is solved by the method according to the invention and by the forming device according to the invention for producing an inner and an outer ring-shaped formed part from a blank, as defined in independent claim 1. Especially advantageous developments and embodiments of the method according to the invention and the forming device according to the invention will be apparent from the respective dependent claims.

In respect of the method, the core of the invention lies in the following: a method for producing an inner and an outer ring-shaped formed part from a blank comprises the following steps:

- cup extrusion of the blank to form a cup having a drawn-out cup base and an adjoining stepless cup wall,
- forming of the cup wall in such a way that the formed cup wall comprises an inner ring-shaped section and an adjoining outer ring-shaped section which is partly offset in an axial direction, and
- separation of the outer ring-shaped section from the inner ring-shaped section and separation of the inner ring-shaped section from the drawn-out cup base, the detached outer ring-shaped section constituting the outer ring-shaped formed part and the detached inner ring-shaped section constituting the inner ring-shaped formed part.

An advantage of the method according to the invention is that in the first step of the method a cup having a drawn-out cup base and an adjoining stepless cup wall is created, stepless here being understood to mean that a cross-section of the shaped cup wall has no stepped contours. There are accordingly no abrupt transitions between regions of different internal or external diameter in the cup wall. Such a stepless cup wall can accordingly be shaped using stepless forming tools, such as, for example, a stepless forming punch and a stepless forming die. As a result, the flow of the material of the blank is not hindered by stepped shapes and the forming tool, especially the forming punch, is able to displace the material of the blank substantially without hindrance during the cup extrusion. In that way a relatively thin cup base can be drawn out. In the cup extrusion step, the cup base of the cup is drawn out to substantially its final shape and does not undergo any significant further forming in the subsequent step of forming the cup wall. This also implies that the thickness of the cup base is fixed by the cup extrusion step and does not undergo any significant further alteration during the forming of the cup wall. In the case of the methods of the prior art discussed above, in which the ring-shaped sections of the shaped cup wall are shaped in the same step as the cup base or the residual base portion, the stepped cross-section of the corresponding forming tools that is necessary for that purpose impedes the flow of the material, resulting in a thicker cup base or residual base portion compared with the method according to the invention.

The separation of the outer ring-shaped section from the inner ring-shaped section and the separation of the inner ring-shaped section from the drawn-out cup base, the detached outer ring-shaped section constituting the outer ring-shaped formed part and the detached inner ring-shaped section constituting the inner ring-shaped formed part, can be effected simultaneously or at different times and independently of one another. For example, in a first separating step the outer ring-shaped section can be separated from the inner ring-shaped section and in a second separating step the inner ring-shaped section can be separated from the drawn-out cup base or vice versa. The two separating steps can be carried out in the same forming station or in different forming stations.

The inner and outer ring-shaped formed parts produced by the method according to the invention are processed further, for example in subsequent working steps, such as rolling and expansion, to form an inner ring and an outer ring of a rolling bearing, as described, for example, in EP 3 362 204 B1. Since the cup base is detached and discarded as waste material, the method according to the invention is able to reduce the amount of waste material by virtue of the thinner cup base. Furthermore, there is also a reduction in the energy consumption for the forming process on account of the smaller amount of force required.

Typical materials for the blank for the production of such ring-shaped formed parts for further processing into rolling bearing rings include metals, such as, for example, steel or rolling bearing steel.

A blank is especially suitable for the method according to the invention if its external diameter corresponds approximately to an external diameter of the outer ring-shaped formed part. The blank is advantageously disc-shaped.

Preferably, during the cup extrusion of the blank the cup base is shaped between an end face of a first forming punch portion and a support face of an ejector.

The shaping of the cup base between an end face of a first forming punch portion and a support face of an ejector has the advantage that the shape of the forming station can be varied by movement of the ejector having the support face. In particular, in an especially advantageous embodiment in which the ejector is arranged to be retractable, that is to say movable in a direction pointing away from the forming punch, regions of a forming die, especially a stepped region, can be exposed by retraction of the support face, thus allowing a multi-step forming method using only one forming station. Furthermore, after the forming of the cup wall the formed cup can simply be ejected by means of the support face arranged on the ejector, without the need for an ejection element in addition to the ejector having the support face that is anyway used for shaping the cup base.

Advantageously, during the cup extrusion of the blank at least a part of a peripheral inner surface of the inner ring-shaped formed part is shaped by a peripheral outer surface of the first forming punch portion.

A peripheral outer surface is here to be understood as being a lateral face which, projecting away from the end face, surrounds the forming punch portion on a side of the forming punch portion. A first forming punch portion so configured is advantageous for the displacement of the material of the blank. It can thereby be ensured that material of the blank does not flow behind the end face of the forming punch portion during the cup extrusion, which blank material would have to be displaced again in the subsequent step of forming the cup wall. Furthermore, at least a part of the peripheral inner surface of the inner ring-shaped formed part is already drawn out as a result and additional forming of that inner surface in the subsequent step of forming the cup wall can thus be avoided.

In an advantageous embodiment, the cup extrusion of the blank is effected in a first forming station with a stepless forming die and the forming of the cup wall is effected in a second forming station with a forming die having a stepped region.

In that case, after the cup extrusion, the cup from the first forming station with the stepless forming die is transferred to a second forming station with a forming die that is different from the stepless forming die and has a stepped region. This has the advantage that the method according to the invention can be carried out without the need for movable elements for altering the shape of the forming die or for exposing parts of the forming die that are not accessible for the cup extrusion of the blank.

In an alternative advantageous embodiment, the cup extrusion of the blank and the forming of the cup wall are carried out in succession in the same forming station with only one forming die.

This embodiment has the advantage that the cup does not need to be transferred from one forming station or forming die to another after the cup extrusion. It is thus possible to save the time required for the transfer. In addition, the gripping tool required for the transfer of the cup as well as the space required for the additional forming station are unnecessary.

Preferably, the forming die comprises a stepped region for forming the cup wall, and a peripheral inner surface of the stepped region of the forming die is exposed by retraction of the ejector having the support face.

This has the advantage that the ejector having the support face, which is anyway used for the shaping of the cup base and for ejecting the formed cup, can also be employed for adapting the forming die used for the cup extrusion. Accordingly, no further movable elements are necessary for that purpose. This is a simple method by which, after the cup extrusion, a stepped region of the forming die can be provided for forming the cup wall. A stepped region of a forming die is here to be understood as being the region of a forming die which, due to sub-regions of different internal diameters, has stepped contours in cross-section. Such a stepped region of the forming die is necessary for shaping the respective outer surfaces of the inner and outer ring-shaped sections of the formed cup which have different external diameters.

In a preferred embodiment, the cup extrusion of the blank and the forming of the cup wall are effected by hot-forming at temperatures of 500° C. and above.

Hot-forming at the said temperatures allows easier forming of the blank or the cup in comparison with cold-forming.

A forming device according to the invention for producing an inner and an outer ring-shaped formed part from a blank comprises:

- a first forming punch portion for cup extrusion of the blank to form a cup having a drawn-out cup base and an adjoining stepless cup wall, a second forming punch portion and a forming die having a stepped region for forming the cup wall in such a way that it comprises an inner ring-shaped section and an adjoining outer ring-shaped section which is partly offset in an axial direction, and a separating tool for separating the outer ring-shaped section from the inner ring-shaped section and for separating the inner ring-shaped section from the drawn-out cup base, the detached outer ring-shaped section constituting the outer ring-shaped formed part and the detached inner ring-shaped section constituting the inner ring-shaped formed part.

The forming device according to the invention offers the same advantages as the method according to the invention.

Stepped and stepless are here to be understood as described above. In this regard the first and the second forming punch portions can be different parts of the same forming punch, but can also be parts of two different forming punches. In a preferred embodiment, a suitable separating tool can be a stamping tool. Additional tools, such as, for example, a rolling tool or an expanding tool, can be provided.

Preferably the forming device comprises an ejector having a support face, and the first forming punch portion comprises an end face for shaping the cup base during the cup extrusion of the blank.

The ejector is advantageously configured both for ejecting the formed cup and for providing and holding the support face during the cup extrusion or the forming of the cup wall and can preferably be moved by means of a hydraulically controlled actuator. A suitable hydraulic system, which provides a supporting force sufficient that the ejector is also suitable for holding the support face during the cup extrusion or the forming of the cup wall, is described in EP 3 362 204 B1.

The support face of the ejector and the end face of the first forming punch portion are preferably arranged opposite one another in order to allow shaping of the cup base between those two faces. Preferably, the distances between the end face and the support face are in a range of from 1 mm to 6 mm at a thinnest point in order to shape a cup base of corresponding thickness.

In an advantageous embodiment, the first forming punch portion comprises a first peripheral outer surface for shaping at least a part of a peripheral inner surface of the inner ring-shaped formed part.

In a further advantageous embodiment, the ejector having the support face is arranged to be retractable in order to expose a peripheral inner surface of the stepped region of the forming die for forming the cup wall.

Retractable is to be understood here as meaning movable in a direction pointing away from the forming punch portion. The ejector can be retracted, for example, as a result of the force exerted on the blank or cup by the first forming punch portion.

In an advantageous embodiment, the first forming punch portion, the second forming punch portion and the forming die having the stepped region are part of a common forming station.

In an alternative advantageous embodiment, the first forming punch portion and a stepless forming die are part of a first forming station, and the second forming punch portion and the forming die having the stepped region are part of a second forming station.

BRIEF DESCRIPTION OF THE DRAWINGS

The terms Fig., Figs., Figure, and Figures are used interchangeably in the specification to refer to the corresponding figures in the drawings.

The method according to the invention and the forming device according to the invention for producing an inner and an outer ring-shaped formed part from a blank are described in greater detail below with reference to two exemplary embodiments shown in the drawings, wherein.

DESCRIPTION

The following observations apply in respect of the description which follows: where, for the purpose of clarity of the drawings, reference signs are included in a Figure but are not mentioned in the directly associated part of the description, reference should be made to the explanation of those reference symbols in the preceding or subsequent parts of the description. Conversely, to avoid overcomplication of the drawings, reference signs that are less relevant for immediate understanding are not included in all Figures. In that case, reference should be made to the other Figures.

Figure 1:
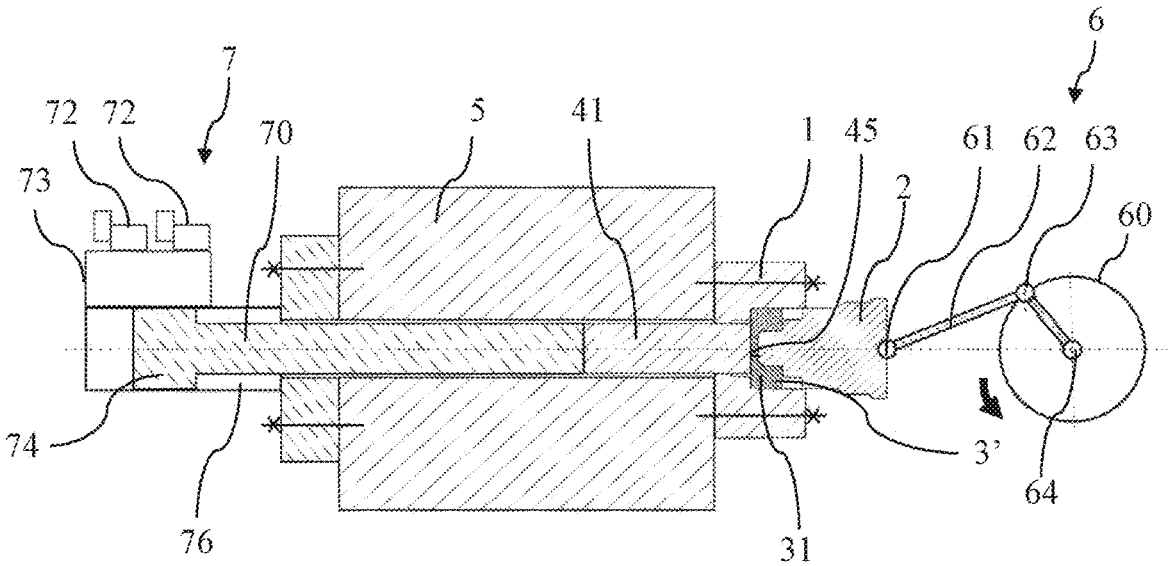
FIG. 1—is a diagrammatic cross-sectional view of a forming station of a first exemplary embodiment of the forming device according to the invention after the cup extrusion.
Figure 2:
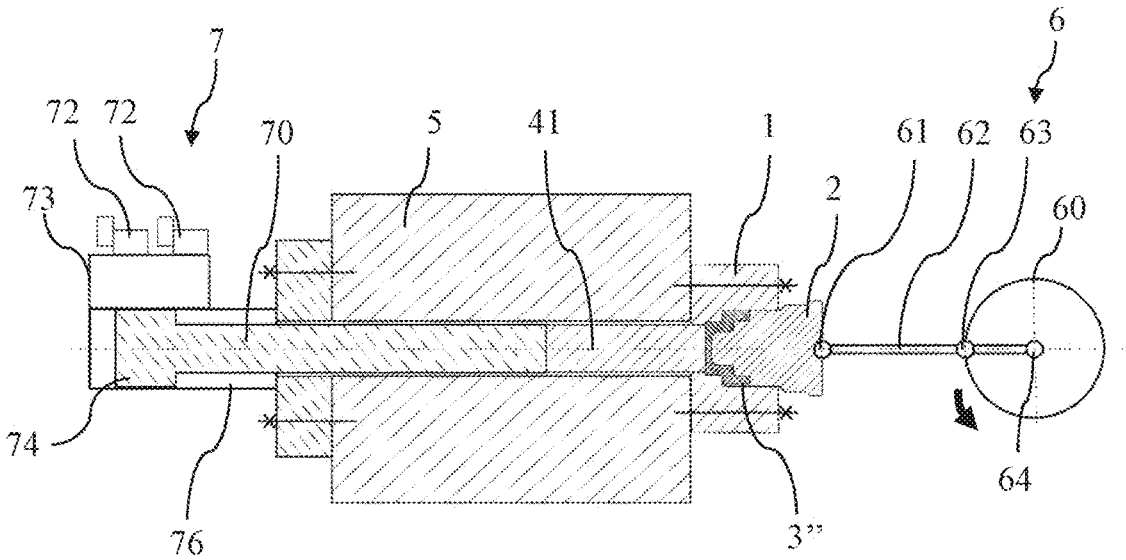
FIG. 2—is a diagrammatic cross-sectional view of the forming station of FIG. 1 after the forming of the cup wall.
Figure 3:
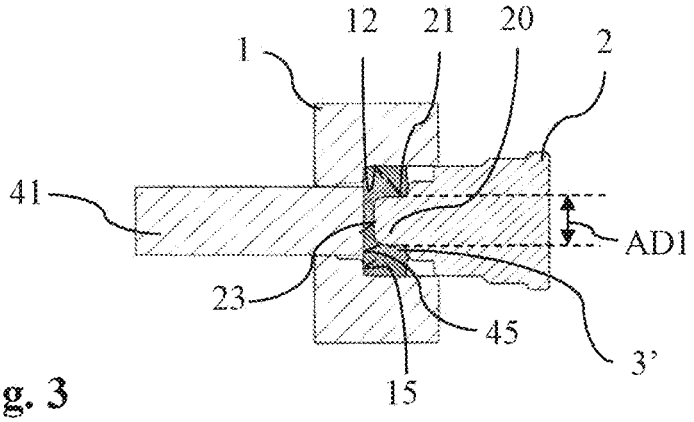
FIG. 3—is a diagrammatic detail view of FIG. 1 with a cup between a forming die and a forming punch after the cup extrusion.
Figure 4:
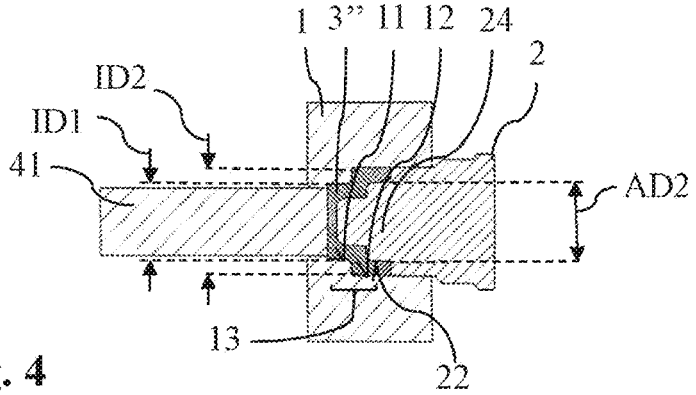
FIG. 4—is a diagrammatic detail view of FIG. 2 with a formed cup between the forming die and the forming punch after the forming of the cup wall.

FIGS. 1 and 2 show a diagrammatic cross-sectional view of a forming station of a first exemplary embodiment of the forming device according to the invention at the end of two working steps; FIGS. 3 and 4 show two corresponding diagrammatic detail views; and FIGS. 5 to 8 show a workpiece, typically made of metal, processed using the forming device in four different processing phases.

FIG. 1 shows the forming station in a first arrangement at the end of a cup extrusion of a disc-shaped blank 3 (see FIG. 5) to form a cup 3' having a cup wall 31. The forming device comprises a machine body 5 and a forming die 1 attached thereto in which the cup 3' shaped from the blank 3 by cup extrusion is arranged. The forming die 1 is bounded on a side that faces towards the machine body 5 by a support face 45 of a movably arranged ejector 41. The forming device further comprises a forming punch 2 driven by a punch drive 6. The punch drive 6 comprises a punch drive crank 60 which is driven by a punch drive shaft 64 and is connected via an articulated connection 63 to a punch drive rod 62 which is in turn connected via a further articulated connection 61 to the forming punch 2. For the cup extrusion, the punch drive crank 60 is turned in the direction of rotation indicated by the arrow by the punch drive shaft 64 and the forming punch 2 is pressed against the blank 3 arranged in the forming die 1 and the blank 3 is formed into the cup 3' by the force of the forming punch 2.

The arrangement further comprises a hydraulically operated actuator 70 which is movably mounted in the machine body 5 and supports the ejector 41, which is likewise movably mounted in the machine body 5. For moving or adjusting the actuator 70, a piston 74, which is rigidly connected to the actuator 70, is moved forwards (in the direction of the forming die 1) and backwards (in the direction away from the forming die 1) in a hydraulic chamber 76 of a hydraulic system 7 by means of a hydraulic medium, especially hydraulic oil. The actuator 70, the piston 74 and the hydraulic chamber 76 are each circular-cylindrical, but in alternative embodiments may also have other shapes. The hydraulic system 7 further comprises a position-measuring device with a measuring electronics system, and further hydraulic elements, such as a hydraulic source, lines, hydroaccumulators and collecting tanks. In the drawing those elements have been combined in a hydraulic block 73. Of the elements relevant to the hydraulic system 7, for reasons of clarity the Figure shows only the two servo valves 72 for supplying and discharging hydraulic medium to and from the hydraulic chamber 76. For moving the piston 74 and the actuator 70 in the direction towards the forming die 1, or for exerting a force in that direction, the hydraulic medium is supplied via the servo valves 72 to a region of the hydraulic chamber 76 behind the piston 74 (that is to say on the side of the piston 74 remote from the forming die 1) and discharged from a region of the hydraulic chamber 76 in front of the piston 74. Accordingly, for moving the piston 74 in the opposite direction, the hydraulic medium is supplied via the two servo valves 72 to the region of the hydraulic chamber 76 in front of the piston and discharged from the region of the hydraulic chamber 76 behind the piston. The movement of the piston 74 and the actuator 70 rigidly connected thereto in a hydraulic system 7 corresponds to the prior art and needs no further explanation. Further details relating to such a hydraulic system 7 are described, for example, in WO 2017/072173 A1.

By means of the actuator 70, a force can be exerted on the ejector 41 in the direction of the forming die 1. The hydraulic system 7 used here, like the system described in WO 2017/072173 A1, is configured, on the one hand, to support the blank 3 during the cup extrusion and the cup 3' during the forming of the cup wall 31 and, on the other hand, to eject a formed cup 3" (see FIGS. 2 and 7) from the forming die 1.

FIG. 1 shows the forming device in an arrangement in which the blank 3 has just been formed into the cup 3'. FIG. 2 shows the forming device in an arrangement in which the cup wall 31 of the previously shaped cup 3' has been formed in a process step that follows the cup extrusion. As shown in FIG. 2, the actuator 70 has been retracted, with the result that the ejector 41 can also be retracted in order to expose a stepped region of the forming die 1 for forming the cup wall. Furthermore, the forming punch 2 has been pressed further against the cup 3' arranged in the forming die 1 and formed into the formed cup 3" by forming of the cup wall 31. The forming punch 2 has been moved by further rotation of the punch drive crank 60 in the direction of rotation indicated by the arrow.

The method for producing an inner and an outer ring-shaped formed part from the blank 3 will now be described in detail with reference to FIGS. 3 and 4, which show detailed views of the forming die 1, of the forming punch 2 and of the ejector 41, and with reference to FIGS. 5 to 8, which show the blank 3, the cup 3', the formed cup 3" as well as an inner ring-shaped formed part 39 and an outer ring-shaped formed part 38 in a cross-sectional view.

Figure 5:
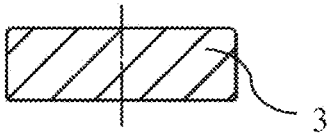
FIG. 5—is a diagrammatic cross-sectional view of a blank.
Figure 7:
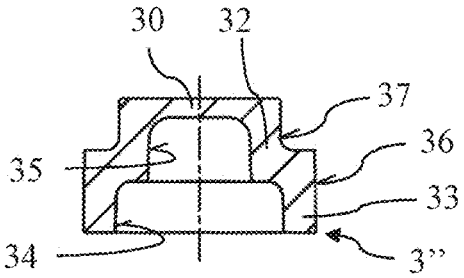
FIG. 7—is a diagrammatic cross-sectional view of a formed cup after the forming of the cup wall.
Figure 8:
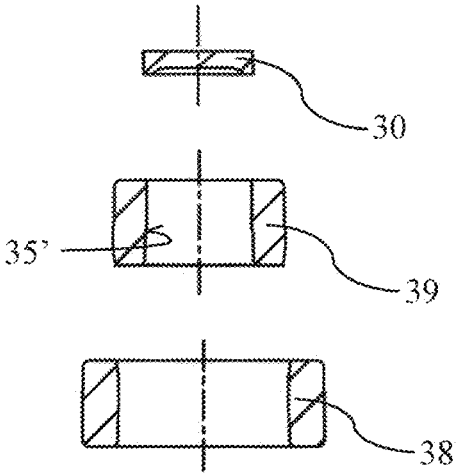
FIG. 8—is a diagrammatic cross-sectional view of the cup base, of the inner ring-shaped formed part and of the outer ring-shaped formed part after the separation.

FIG. 3 shows a cross-sectional view of the ejector 41, of the forming punch 2 and of a forming die 1 with the cup 3' arranged in the forming die 1. The arrangement corresponds to the arrangement shown in FIG. 1 in which the blank 3 has been formed into the cup 3' by cup extrusion. Such a disc-shaped blank 3 is shown in FIG. 5. Here the blank 3, like all other objects and workpieces shown in cross-sectional views in FIGS. 6 to 8, is rotationally symmetrical about the respective dotted line.

Figure 6:
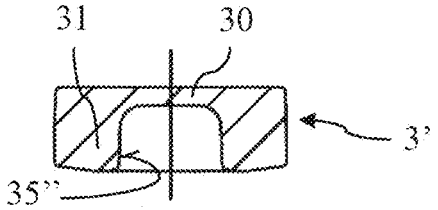
FIG. 6—is a diagrammatic cross-sectional view of a cup shaped by cup extrusion.

An enlarged view of the cup 3' is shown in FIG. 6. It comprises the stepless cup wall 31, which has a peripheral inner surface 35", and a drawn-out cup base 30. The shape of the cup 3' is essentially determined by the support face 45 of the ejector 41, by a step surface 15 of the forming die 1, which step surface is arranged in the same plane as the support face 45 in the arrangement according to FIG. 3 and annularly surrounds the support face, by a stepless peripheral inner surface 12 of the forming die 1, by an end face 23 of a first forming punch portion 20 of the forming punch 2 and by a first peripheral outer surface 21 of the first forming punch portion 20. The cup base 30 is shaped between the support face 45 of the ejector 41 and the end face 23 of the first forming punch portion 20. The distance between the support face 45 and the end face 23 is preferably in a range of from 1 mm to 6 mm and in this exemplary embodiment is approximately 3 mm, so that the cup base 30 is shaped to a thickness corresponding to that distance. The first peripheral outer surface 21 of the first forming punch portion 20 shapes the peripheral inner surface 35" of the cup 3'. The latter surface in turn constitutes a part of a peripheral inner surface 35' of the inner ring-shaped formed part 39 shown in FIG. 8. The first forming punch portion 20 has a first external diameter AD1 in a range of from 10 mm to 150 mm.

FIG. 4 shows a cross-sectional view of the same elements as FIG. 3, but in the arrangement shown in FIG. 2 in which the cup 3' has already been formed into the formed cup 3" by forming of the cup wall 31. The formed cup 3" is shown in FIG. 7. It comprises an inner ring-shaped section 32 and an outer ring-shaped section 33.

The ejector 41 having the support face 45 has been retracted, with the result that a region of the forming die 1 having a first peripheral inner surface 11 has been exposed. The region of the forming die 1 having the first peripheral inner surface 11 has a first internal diameter ID1. The region of the forming die 1 having the second peripheral inner surface 12 has a second internal diameter ID2, the first internal diameter ID1 being smaller than the second internal diameter ID2.

The first internal diameter ID1 is in a range of from 16 mm to 170 mm and the second internal diameter ID2 is in a range of from 22 mm to 190 mm. As a result of the two different internal diameters ID1, ID2, a step having the step surface 15 is created at the transition between the first and second peripheral inner surfaces 11, 12. The first peripheral inner surface 11, together with the second peripheral inner surface 12, creates a stepped region 13 of the forming die 1.

The forming punch 2 is pressed against the cup 3' arranged in the forming die 1, with the result that the stepless cup wall 31 is formed into the inner ring-shaped section 32 and the outer ring-shaped section 33 of the formed cup 3". The first peripheral inner surface 11 of the forming die 1 shapes the peripheral outer surface 37 of the inner ring-shaped section 32 and the second peripheral inner surface 12 shapes the peripheral outer surface 36 of the outer ring-shaped section 33. The peripheral inner surface 35—which corresponds to a part of the peripheral inner surface 35' of the inner ring-shaped formed part 39—has already been shaped in the preceding step as part of the peripheral inner surface 35" of the cup 3'. The forming punch 2 further comprises a second forming punch portion 24 having an external diameter AD2 in a range of from 16 mm to 170 mm. A second peripheral outer surface 22 of the second forming punch portion 24 shapes the peripheral inner surface 34 of the outer ring-shaped section 33. The radial dimensions of the formed cup 3" are accordingly determined by the first and second external diameters AD1, AD2 of the respective forming punch portions and by the first and second internal diameters ID1, ID2 of the respective regions of the forming die 1.

The cup extrusion of the blank 3 to form the cup 3' and the forming of the cup wall 31 are carried out by hot-forming at temperatures of 500° C. and above. In an alternative exemplary embodiment those forming processes can also be carried out by cold-forming.

After the forming of the cup wall 31, the forming punch 2 is moved away from the formed cup 3" and from the forming die 1 again by means of the punch drive 6 by further rotation of the punch drive crank 60. The formed cup 3" is then ejected from the forming die 1 by means of the ejector 41.

After the ejection, in a further working step not shown in the Figures the outer ring-shaped formed part 38 and the inner ring-shaped formed part 39 are produced from the formed cup 3", see FIG. 8. For that purpose, by means of a suitable separating tool, especially a stamping tool, the outer ring-shaped section 33 is separated from the inner ring-shaped section 32 and the inner ring-shaped section 32 is separated from the cup base 30. The detached outer ring-shaped section 33 constitutes the outer ring-shaped formed part 38 and the detached inner ring-shaped section 32 constitutes the inner ring-shaped formed part 39. In addition, after the separation the outer ring-shaped formed part 38 and the inner ring-shaped formed part 39 are usually rolled or expanded. The stamped-out cup base 30 is discarded as waste.

Figure 9:
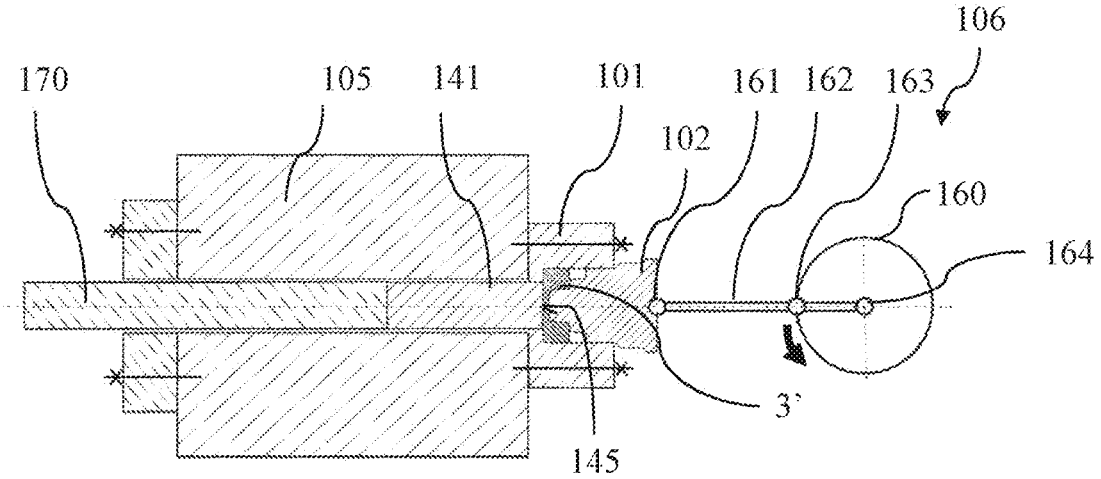
FIG. 9—is a diagrammatic cross-sectional view of a first forming station of a second exemplary embodiment of the forming device according to the invention after the cup extrusion.
Figure 10:
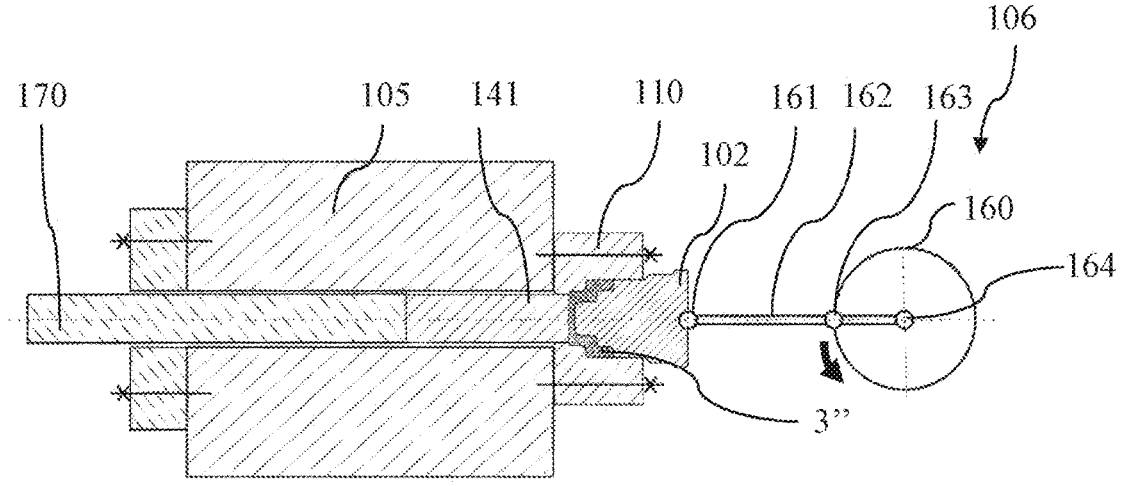
FIG. 10—is a diagrammatic cross-sectional view of a second forming station of the second exemplary embodiment of the forming device according to the invention after the forming of the cup wall.
Figure 11:
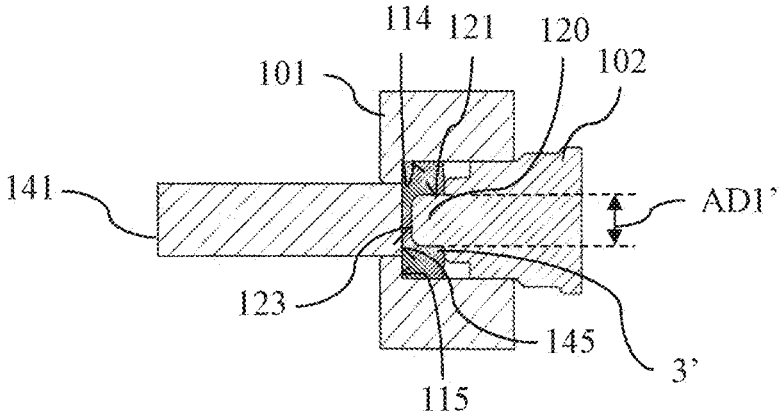
FIG. 11—is a diagrammatic detail view of FIG. 9 with a cup between a stepless forming die and a forming punch after the cup extrusion.
Figure 12:
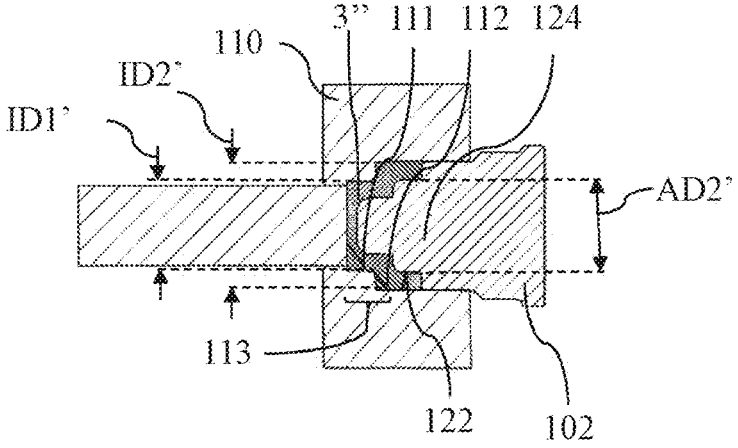
FIG. 12—is a diagrammatic detail view of FIG. 10 with a formed cup between a forming die having a stepped region and a forming punch after the forming of the cup wall.

FIGS. 9 and 10 show diagrammatic cross-sectional views of a first and a second forming station of a second exemplary embodiment of the forming device according to the invention at the end of two working steps and FIGS. 11 and 12 show two corresponding diagrammatic detail views. As in the case of the first exemplary embodiment, FIGS. 5 to 8 show a workpiece processed using the forming device in four different processing phases.

FIG. 9 shows the first forming station of the forming device at the end of the cup extrusion of the blank 3 to form a cup 3'. The first forming station comprises a machine body 105 and a stepless forming die 101 attached thereto in which the cup 3' shaped from the blank 3 by cup extrusion is arranged. The forming die 101 is bounded on a side that faces towards the machine body 105 by a support face 145 of an ejector 141. The forming device further comprises a forming punch 102 driven by a punch drive 106. The punch drive 106 comprises a punch drive crank 160 which is driven by a punch drive shaft 164 and is connected via an articulated connection 163 to a punch drive rod 162 which is in turn connected via a further articulated connection 161 to the forming punch 102. For the cup extrusion, the punch drive crank 160 is turned in the direction of rotation indicated by the arrow by the punch drive shaft 164 and the forming punch 102 is pressed against the blank 3 arranged in the forming die 101 and the blank 3 is formed into the cup 3' by the pressure of the forming punch 102. In the arrangement shown in FIG. 9, in which the cup 3' has just been shaped, the forming punch 102 has already been displaced to its maximum extent and cannot be moved further in the direction of the cup 3' or the forming die 101 even by further rotation of the punch drive crank 160.

Instead, further rotation of the punch drive crank 160 causes the forming punch 102 to move away from the cup 3' and from the stepless forming die 101, and the cup 3' can be ejected by means of the ejector 141.

For forming the cup wall 31, the cup 3' is transferred to a second forming station which is shown in FIG. 10.

The second forming station is constructed identically to the first forming station with the exception of the forming die. In the second forming station the stepless forming die 101 has been replaced by a forming die 110 comprising a stepped region. In this exemplary embodiment the forming punch 102 is also constructed identically to the forming punch 102 of the first forming station and has therefore been given the same reference sign. In alternative embodiments it would also be possible for two different forming punches to be used.

For forming the cup wall 31 of the cup 3' arranged in the forming die 110, the punch drive crank 160 is again turned in the direction of rotation indicated by the arrow by the punch drive shaft 164 and the forming punch 102 is pressed against the cup 3' arranged in the forming die 101. The cup 3' is formed into the formed cup 3" by forming of the cup wall 31. In the arrangement shown in FIG. 10, in which the formed cup 3" has just been shaped, the forming punch 102 has already been displaced to its maximum extent and cannot be moved further in the direction of the formed cup 3" or the forming die 110 even by further rotation of the punch drive crank 160.

In this second exemplary embodiment, the ejector 141 can likewise be moved by an actuator 170 but only in order to eject the cup 3' from the forming die 101 or the formed cup 3" from the forming die 110. In this exemplary embodiment the ejector 141 need not be capable of further retraction. Such an ejection mechanism corresponds to the prior art and is not further described herein. In alternative exemplary embodiments, the forming dies 101, 110 can also be bounded by an immovable boundary wall instead of by the support face 145 of the ejector 141, and the cup 3' or the formed cup 3" can be removed from the respective forming die 101, 110 from the side that faces towards the forming punch 102.

FIG. 11 shows a cross-sectional view of the ejector 141, of the forming punch 102 and of the stepless forming die 101 with the cup 3' arranged therein. The arrangement corresponds to the arrangement of the first forming station shown in FIG. 9 in which the blank 3 has been formed into the cup 3' by cup extrusion.

The shape of the cup 3' is essentially determined by the support face 145 of the ejector 141, by a base surface 115 of the forming die 101, which base surface is arranged in the same plane as the support face 145 in the arrangement according to FIG. 11 and annularly surrounds the support face, by a stepless peripheral inner surface 114 of the forming die 101, by an end face 123 of a first forming punch portion 120 of the forming punch 102 and by a first peripheral outer surface 121 of the first forming punch portion 120. The cup base 30 is shaped between a support face 145 of the ejector 141 and the end face 123 of the first forming punch portion 120. In an alternative exemplary embodiment, the support face 145 can also be a surface of an immovable boundary wall. The first peripheral outer surface 121 of the first forming punch portion 120 shapes the peripheral inner surface 35" of the cup 3'. The latter surface in turn constitutes a part of the peripheral inner surface 35' of the inner ring-shaped formed part 39.

FIG. 12 shows a cross-sectional view of the ejector 141, of the forming punch 102 and of a forming die 110 comprising a stepped region 113, with the formed cup 3" arranged in the forming die 110. The arrangement corresponds to the arrangement of the second forming station shown in FIG. 10 in which the cup 3' has already been formed into the formed cup 3" by forming of the cup wall 31.

The forming die 110 comprises a region having a first peripheral inner surface 111 with a first internal diameter ID1' and a region with a second internal diameter ID2', the first internal diameter ID1' being smaller than the second internal diameter ID2'. A step is created at the transition between the first peripheral inner surface 111 and the second peripheral inner surface 112, and the first peripheral inner surface 111 and the second peripheral inner surface 112 constitute a stepped region 113.

The forming punch 102 is pressed against the cup 3' arranged in the forming die 110, with the result that the stepless cup wall 31 is formed into the inner ring-shaped section 32 and the outer ring-shaped section 33 of the formed cup 3". The first peripheral inner surface 111 of the forming die 110 shapes the peripheral outer surface 37 of the inner ring-shaped section 32 and the second peripheral inner surface 112 shapes the peripheral outer surface 36 of the outer ring-shaped section 33. The peripheral inner surface 35—which corresponds to a part of the peripheral inner surface 35' of the inner ring-shaped formed part 39—has already been shaped in the preceding step as part of the peripheral inner surface 35" of the cup 3'. The forming punch 102 further comprises a second forming punch portion 124 having an external diameter AD2' that is larger than the first external diameter AD1'. A second peripheral outer surface 122 of the second forming punch portion 124 shapes the peripheral inner surface 34 of the outer ring-shaped section 33.

The external diameters AD1', AD2' and the internal diameters ID1', ID2' correspond to the external diameters AD1, AD2 and the internal diameters ID1, ID2, respectively, of the first exemplary embodiment.

The subsequent working steps for producing the outer ring-shaped formed part 38 and the inner ring-shaped formed part 39 correspond to those of the first exemplary embodiment and are therefore not repeated here.

The invention claimed is:

1. A method for producing an inner and an outer ring-shaped formed part from a blank, comprising the steps:

cup extrusion of the blank to form a cup having a drawn-out cup base and an adjoining stepless cup wall, wherein during the cup extrusion of the blank the cup base is shaped between an end face of a first forming punch portion and a support face of an ejector, and wherein during the cup extrusion of the blank at least a part of a peripheral inner surface of the inner ring-shaped formed part is shaped by a peripheral outer surface of the first forming punch portion;

forming of the cup wall in such a way that the formed cup wall comprises an inner ring-shaped section and an adjoining outer ring-shaped section which is partly offset in an axial direction; and separation of the outer ring-shaped section from the inner ring-shaped section and separation of the inner ring-shaped section from the drawn-out cup base, the detached outer ring-shaped section constituting the outer ring-shaped formed part and the detached inner ring-shaped section constituting the inner ring-shaped formed part.

2. The method according to claim 1, wherein the cup extrusion of the blank is effected in a first forming station with a stepless forming die and the forming of the cup wall is effected in a second forming station with a forming die having a stepped region.

3. The method according to claim 1, wherein the cup extrusion of the blank and the forming of the cup wall are carried out in succession in the same forming station with only one forming die.

4. The method according to claim 1, wherein the forming die comprises a stepped region for forming the cup wall, and a peripheral inner surface of the stepped region of the forming die is exposed by retraction of the ejector having the support face.

5. The method according to claim 1, wherein the cup extrusion of the blank and the forming of the cup wall are effected by hot-forming at temperatures of 500° C. and above.

* * * * *